US005456177A

United States Patent [19]

Hasegawa

[11] Patent Number: 5,456,177

[45] Date of Patent: Oct. 10, 1995

[54] MASTER PLATE SHEET CLAMPING DEVICE FOR A ROTARY PRINTER

[75] Inventor: Takanori Hasegawa, Tokyo, Japan

[73] Assignee: Riso Kagaku Corporation, Tokyo, Japan

[21] Appl. No.: 148,860

[22] Filed: Nov. 8, 1993

[30] Foreign Application Priority Data

Nov. 6, 1992 [JP] Japan ..... 4-297135

[51] Int. Cl.[6] ..... B41F 27/00

[52] U.S. Cl. ..... 101/382.1; 101/415.1

[58] Field of Search ..... 101/382.1, 415.1, 101/408, 409, 410; 439/866, 867, 868

[56] References Cited

U.S. PATENT DOCUMENTS

| | | | |
|---|---|---|---|
| 1,619,086 | 3/1927 | Oldmixon | 439/867 |
| 3,567,175 | 2/1971 | Torresen | 101/408 |
| 3,664,260 | 5/1972 | Miller et al. | 101/415.1 |
| 3,768,406 | 10/1973 | Gutshe et al. | 101/409 |
| 5,035,175 | 7/1991 | Takita et al. | 101/116 |
| 5,167,186 | 12/1992 | Honkawa et al. | 101/415.1 |
| 5,224,875 | 7/1993 | Watanabe et al. | 439/867 |
| 5,253,583 | 10/1993 | Yamamoto et al. | 101/415.1 |

FOREIGN PATENT DOCUMENTS

| | | | |
|---|---|---|---|
| 355005 | 2/1990 | European Pat. Off. . | |
| 3721965 | 1/1989 | Germany | 439/866 |
| 4137948 | 5/1992 | Germany . | |

*Primary Examiner*—Edgar S. Burr
*Assistant Examiner*—Anthony H. Nguyen
*Attorney, Agent, or Firm*—Dickstein, Shapiro & Morin

[57] ABSTRACT

In a master plate sheet clamping device for a rotary printer in which a moveable clamping plate is provided in the printing drum so as to be moveable between a clamping position for clamping a master plate sheet against the outer circumferential surface of the printing drum and an unclamping position for releasing the master plate sheet from the printing drum, to allow a reliable clamping and unclamping action to be carried out with a highly simple structure without requiring a large solenoid device or a mechanism for preventing the rotation of the printing drum, the printing drum carries a motor for moving the moveable clamping plate between the clamping position and the release position, and electric power is supplied to the motor via power collector members provided on the printing drum and selectively moveable power supply members provided on a fixed member of the printer.

9 Claims, 4 Drawing Sheets

MASTER PLATE SHEET CLAMPING DEVICE FOR A ROTARY PRINTER

TECHNICAL FIELD

The present invention relates to a master plate sheet clamping device for a rotary printer, and in particular to a master plate sheet clamping device for clamping a master plate sheet onto the outer circumferential surface of a rotatively driven printing drum.

BACKGROUND OF THE INVENTION

As a master plate sheet clamping device for mounting a thin master plate sheet such as a stencil master plate sheet on the outer circumferential surface of a printing drum of a rotary stencil printing device, there has been proposed, for instance in Japanese utility model publication (kokoku) No. 1-26463, a master plate sheet clamping device comprising a clamping plate which can angularly move approximately by 180 degrees between a clamping position and an unclamping position around an axial line of the printing drum, and clamps a master plate sheet between the clamping plate at its clamping position and the outer circumferential surface of the printing drum.

The angular movement of the clamping plate between the clamping position and the unclamping position in such a clamping device is accomplished by a gear mounted on a support shaft of the clamping plate, and a motor having an output shaft carrying a drive gear, the motor being moveable between a meshing position for meshing the drive gear with the gear on the support shaft, and a release position for disengaging the drive gear from the gear on the support shaft so as to allow the printing drum to rotate freely. Thus, by moving the motor to the meshing position and bringing the drive gear on the output shaft of the motor in engagement with the gear on the support shaft, the support shaft on the printing drum is angularly actuated by the motor outside the printing drum.

According to such a master plate sheet clamping device, a relatively large solenoid device is necessary for moving the motor between the meshing position and the release position, and there is a possibility that the drive gear on the motor output shaft may not properly mesh with the gear on the support shaft, and the clamping plate may not be properly actuated even when the motor is moved to the meshing position.

Furthermore, to angularly actuate the support shaft on the printing drum from outside the printing drum, a certain mechanism is necessary to prevent the rotation of the printing drum when angularly actuating the support shaft so that the printing drum may be kept stationary and a necessary reaction force may be obtained, and this necessarily increases the complexity of the mechanism.

BRIEF SUMMARY OF THE INVENTION

In view of such problems of the prior art, a primary object of the present invention is to provide a master plate sheet clamping device for a printer which is capable of reliable clamping and unclamping action with a simple structure without requiring a large solenoid or a complex mechanism for preventing the rotation of the printing drum.

A second object of the present invention is to provide a master plate sheet clamping device for a printer which is durable in use.

These and other objects of the present invention can be accomplished by providing a master plate sheet clamping device for a rotary printer which clamps a master plate sheet on an outer circumferential surface of a rotatively driven printing drum, comprising: a moveable clamping member mounted on the printing drum so as to be moveable between a clamping position for clamping a master plate sheet onto an outer circumferential surface of the printing drum and an unclamping position for releasing the master plate sheet from the printing drum; an electric actuator mounted on the printing drum for actuating the moveable clamping member between the clamping position and the release position; and electric power supply means for supplying electric power to the electric actuator.

According to such a structure, electric power is supplied to the electric actuator mounted on the printing drum, and the clamping member can be actuated between the clamping position and the release position by the action of the electric actuator mounted on the printing drum. Thus, the operation of the clamping device is reliable, and the simplified structure increases the durability of the clamping device.

The electric actuator which may consist of an electric motor can be powered by a battery mounted on the printing drum or an electric generator mounted on the printing drum so that the rotation of the printing drum may cause the electric generator to produce electric power. However, it is more preferable if the electric power supply means comprises a power collector member electrically connected to the electric actuator and mounted on the printing drum, and a power supply member connected to an external power source, and mounted on a fixed member of the printer so as to be selectively moved into contact with and away from the power collector member. Typically, the power supply member comprises a pin, and the power collector member comprises socket means adapted to receive the pin for establishing an electric contact therebetween. To avoid the possibility of short-circuiting and electric shock, the power supply member may further comprise an insulating sleeve which is slidably fitted on the pin, and adapted to be retracted so as to expose the pin when the pin is fitted into the socket means.

The position of the clamping member may be detected by using limit switches provided on either terminal points of the movement of the clamping member. However, in view of simplifying the overall structure of the clamping device, it is more preferable if the clamping device comprises control means for controlling the electric actuator, the control means comprising electric current detecting means for detecting a value of electric current supplied to the electric actuator, and electric current control means for stopping the operation of the electric actuator when an electric current detected by the electric current detecting means has exceeded a prescribed value as being indicative of the moveable clamping member reaching the clamping position or the unclamping position. To eliminate the need for any separate means for retaining the clamping member at either terminal point of movement thereof, and improve the clamping action of the clamping member, the electric actuator may comprise a mechanical element such as a worm and gear mechanism which prevents the electric actuator from being moved by a movement of the moveable clamping member, and the moveable clamping member may comprise a spring element for elastically clamping the master plate sheet against an outer circumferential surface of the printing drum.

According to another preferred embodiment of the present invention, the power supply member comprises a pair of power supply brush members, and the power collector member comprises a commutator including a pair of electroconductive segments and insulating gaps defined between the segments adapted to be contacted by the power supply brush members, the segments and the gaps determining a direction and an ending of movement of the electric actuator.

To eliminate the need for any separate means for retaining the clamping member at either terminal point of movement thereof, and improve the clamping action of the clamping member, the clamping device may further comprise spring means for urging the moveable clamping member toward the clamping position and the unclamping position depending on which side of a neutral position the moveable clamping member is located.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
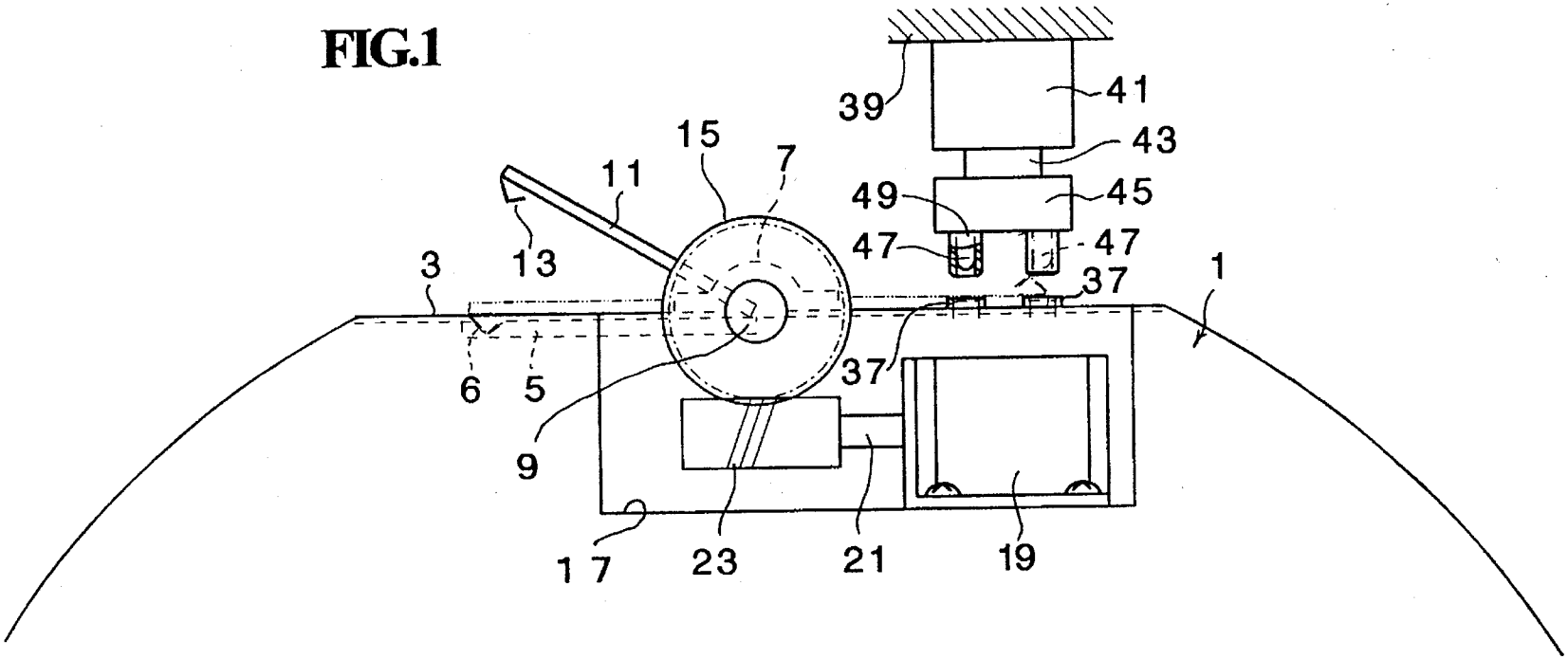
FIG. 1 is a side view showing a preferred embodiment of the master plate sheet clamping device for a printer according to the present invention.
Figure 2:
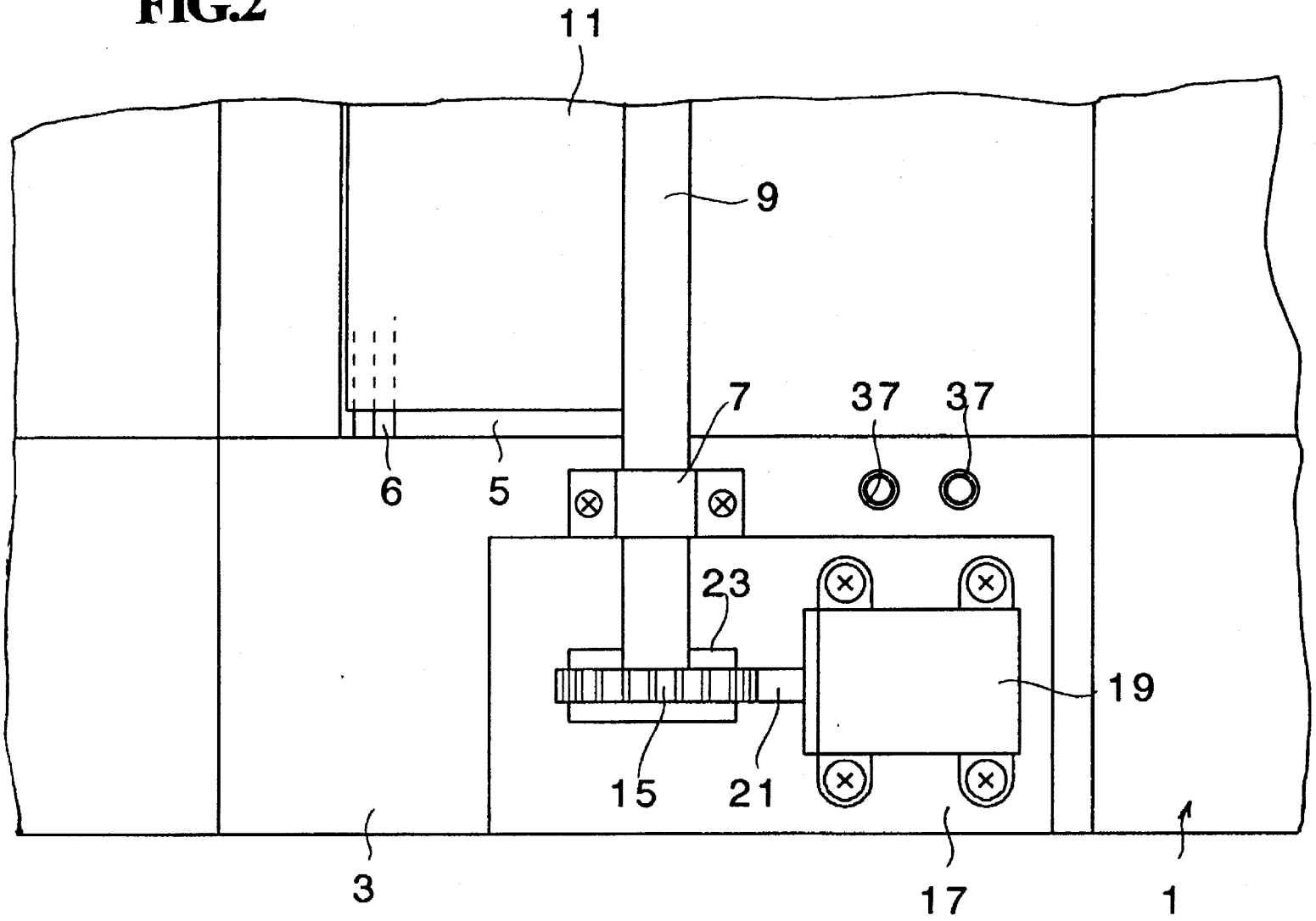
FIG. 2 is a plan view showing preferred embodiment of the master plate sheet clamping device for a printer according to the present invention.

FIGS. 1 through 4 show an embodiment of the master plate sheet clamping device for a printer according to the present invention. In these drawings, numeral 1 denotes a printing drum which is supported by a structure not shown in the drawings so as to be rotatable around its central axial line, and is rotatively actuated in clockwise direction around its central axial line as seen in FIG. 1.

A part of the outer circumferential surface of the printing drum 1 is formed as a flat region 3, and a fixed clamping plate 5 consisting of a band member extending in the axial direction of the printing drum 1 is fixedly secured on this flat region 3.

A pair of bearing brackets 7 are provided on either axial end of this flat region 3, and rotatably support a support shaft 9 extending in the axial direction of the printing drum 1. A moveable clamping plate 11 consisting of a band member is fixedly secured to the support shaft 9. The moveable clamping plate 11 thus can angularly move along with the support shaft 9 between a clamping position for opposing the fixed clamping plate 11, and an unclamping position which is angularly displaced from the clamping position in clockwise direction as seen in FIG. 1 by 180 degrees.

A clamping sheet spring 13 is mounted on a free end of the moveable clamping plate 11, and engages with a groove 6 of the fixed clamping plate 5 when the moveable clamping plate 11 is at the clamping position for elastically clamping a master plate sheet between the moveable clamping plate 11 and the fixed clamping plate 5. Thus, the fixed clamping plate 5 is not required to be a magnetic plate for magnetically attracting the moveable clamping plate 11.

A worm gear 15 is fixedly mounted on an end of the support shaft 9.

A recess 17 is formed in the flat region 3 of the printing drum 1 for receiving the worm gear 15, and a motor 19 serving as the electric actuator is fixedly secured in this recess 17. A worm 23 is mounted on the output shaft 21 of the motor 19, and always meshes with the worm gear 15.

Here, when the motor 19 is turned in the normal direction, the movable clamping plate 11 turns in counter clockwise direction in FIG. 1 or toward the clamping position. When the motor 19 is turned in the reverse direction, the movable clamping plate 11 turns in clockwise direction in FIG. 1 or toward the unclamping position.

Figure 3:
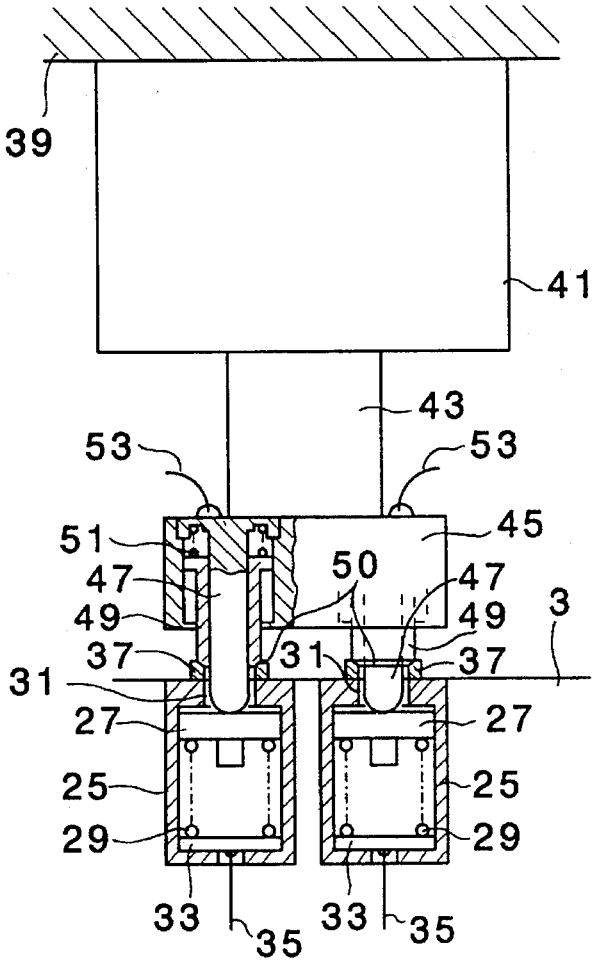
FIG. 3 is an enlarged longitudinal sectional view showing the structure of the electric connecting assembly in the master plate sheet clamping device for a printer according to the present invention.

Referring to FIG. 3, the flat region 3 of the printing drum 1 is provided with a pair of electric collector members 27 received in separate insulating cases 25. Each of the electric collector members 27 is urged toward an upper opening 31 of the associated insulating case 25 by a compression coil spring 29 accommodated in the case 25, and is electrically connected to a lead wire 35 of the motor 19 via a connecting terminal plate 33 of the associated insulating case 25. The flat region 3 is further provided with a pair of tapered positioning rings 37 each aligning with the upper opening 31 of the associated one of the insulating cases 25.

A vertical actuator 41 is mounted on a fixed member 39 of the printer. A power supply box 45 is suspended from a vertically moveable rod 43 of the vertical actuator 41. A pair of power supply pins 47 are provided in the power supply box 45. Each of the power supply pins 47 projects downward from the power supply box 45, and, when the printing drum 1 is in the illustrated angular position, fits into the upper opening 31 of the associated insulating box 25 via the tapered positioning ring 37 so as to be brought in contact with the associated collector member 27.

The power supply box 45 is provided with a pair of insulating sleeves 49 each of which is fitted on an associated one of the power supply pins 47. Each of the insulating sleeves 49 is placed at a lower position for entirely covering the associated power supply pin 47 under the spring force of a spring 51 when the power supply pin 47 is at its upper position spaced from the collector member 27 as illustrated in FIG. 1, and is moved upward relative to the power supply box 45 against the spring force of the spring 51 by engaging with the tapered positioning ring 37 at its tapered tip 50 so as to expose the power supply pin 47 when the power supply pin 47 is at its lower position and is in contact with the associated collector member 27 as illustrated in FIG. 3.

The power supply box 45 is moved vertically between its upper position in which the power supply pins 47 are spaced from the collector members 27, and its lower position in which the power supply pins 47 are in contact with the collector members 27.

Figure 4:
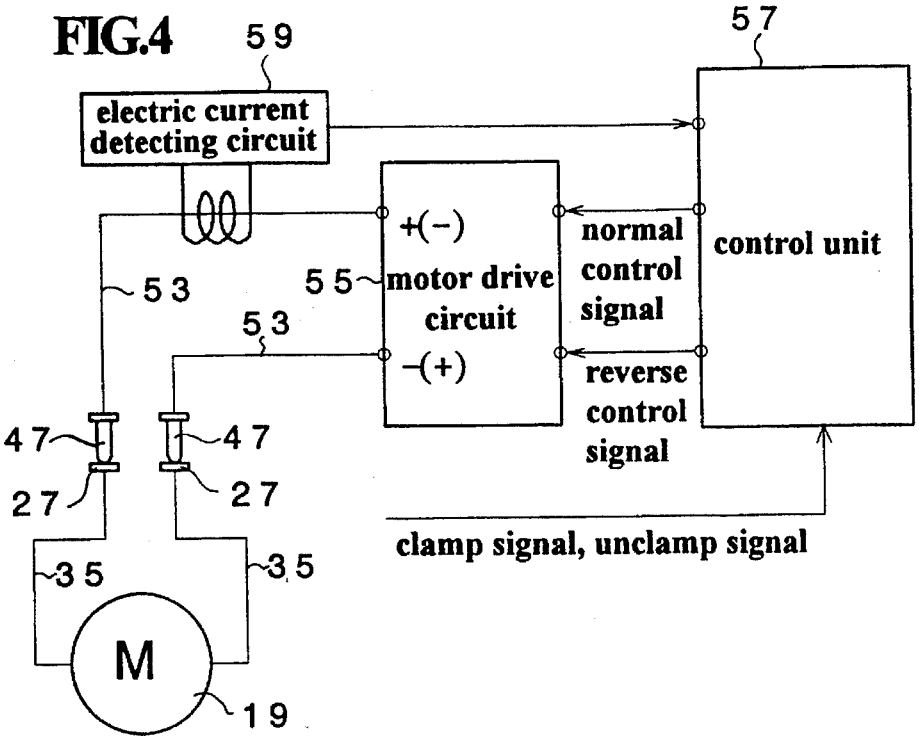
FIG. 4 is an electric circuit diagram of the master plate sheet clamping device for a printer according to the present invention.

Referring to FIG. 4, the two power supply pins 47 are connected to a motor drive circuit 55 via lead wires 53. The motor drive circuit 55 controls the supply of electric power to the motor 19 by feeding a power supply control signal With a control unit 57, and changes the direction of rotation of the motor 19 by feeding a direction control signal with the control device 57.

The control unit 57 comprises a microcomputer which receives a clamp command signal and an unclamp command signal, and receives an electric current value signal corresponding to the electric current supplied to the motor 19 via a current detection circuit 59. When the clamp command signal is received, the control unit 57 supplies a motor normal direction control signal and a power supply control signal to the motor drive circuit 55. When the unclamp command signal is received, the control unit 57 supplies a motor reverse direction control signal and a power supply control signal to the motor drive circuit 55. When the electric current detected by the electric current detection circuit 59 exceeds a prescribed value, the control unit 57 supplies a current stop signal to the motor drive circuit 55, and controls the operation of the vertical actuator 41 accordingly.

According to this structure, upon supplying an unclamp command signal to the control unit 57 when the printing drum 1 is stationary at a prescribed angular position illustrated in FIG. 1, first of all, the power supply box 45 is lowered by the vertical actuator 41 until the two insulating sleeves 49 come into engagement with the tapered positioning rings 37 at their tapered tips 50. As a result, the printing drum 1 is kept stationary at this prescribed angular position.

As the power supply box 45 is lowered even further, the two insulating sleeves 49 are lifted relative to the power supply box 45 against the spring force of the springs 51. As a result, the two power supply pins 47 are exposed, and are fitted into the upper openings 31 of the insulating case 25 via the associated tapered positioning rings 37, and are brought into contact with the collector members 27 in an electroconductive relationship. Thus, the lead wires 35 of the printing drum 1 and the lead wires 53 of the fixed member 39 are electroconductively connected with each other, and the motor 19 and the motor drive circuit 55 are electrically connected with each other.

Then, when the control unit 57 supplies a motor reverse control signal and an electric power supply control signal to the motor drive circuit 55, the motor 19 is drivingly rotated in the reverse direction, and the rotation of the motor 19 is transmitted to the support shaft 9 via the worm 23 and the worm gear 15, which constitute transmitting means, so as to turn the moveable clamping plate 11 in clockwise direction or, in other words, toward the unclamping position. As a result, the moveable clamping plate 11 is moved away from the fixed clamping plate 5, and, if a master sheet has been clamped between the moveable and fixed clamping plates 11 and 5, it is released.

When the moveable clamping plate 11 has reached the unclamping position by the reverse rotation of the motor 19 or the clamping plate has already been placed at the unclamping position by an erroneous operation, the moveable clamping plate 11 cannot turn any further in clockwise direction as seen in FIG. 1 with the result that the load of the motor 19 is increased, and the electric current detected by the electric current detection circuit 59 exceeds the prescribed value. As a result, the control unit 57 issues an electric current supply stop signal to the motor drive circuit 55, and the reverse rotation of the motor 19 is stopped.

After the clamping plate 11 has reached the unclamping position, the master plate sheet which has been clamped is released from the printing drum 1, and a leading edge of a new master plate sheet is placed on the fixed clamping plate 5. When the new master plate sheet is thus mounted, a clamp command signal is supplied to the control unit 57.

Then, a motor normal direction control signal and an electric power control signal are supplied from the control unit 57 to the motor drive circuit 55, and the motor 19 is driven in the normal direction. The rotation of the motor 19 is transmitted to the support shaft 9 via the worm 23 and the worm gear 15, and the moveable clamping plate 11 is turned in counter clockwise direction in. FIG. 1, or toward the clamping position. As a result, the movable clamping plate 11 is engaged with the fixed clamping plate 5, and the clamping sheet spring 13 is fitted into the groove 6 of the fixed clamping plate 5 so as to elastically clamp the master plate sheet against the fixed clamping plate 5.

If the moveable clamping plate 11 has reached the clamping position by the normal rotation of the motor 19 or the moveable clamping plate 11 has already been placed at the clamping position by an erroneous operation, the moveable clamping plate 11 cannot turn any further in counter clockwise direction as seen in FIG. 1 with the result that the load of the motor 19 is increased, and the electric current detected by the electric current detection circuit 59 exceeds the prescribed value. As a result, the control unit 57 issues an electric current supply stop signal to the motor drive circuit 55, and the normal rotation of the motor 19 is stopped.

If it is determined that the moveable clamping plate 11 has already been placed at the clamping position when starting the clamping movement of the moveable clamping plate 11 from the electric current value detected by the electric current detection circuit 59, an error process may be executed.

Because the rotation of the motor 19 is transmitted to the support shaft 9 via the worm 23 and the worm gear 15, the moveable clamping plate 11 is self-retained at the clamping position, and the clamped state of the master plate sheet can be maintained without any continued consumption of power.

Thereafter, the power supply box 45 is lifted by the vertical actuator 41 until the two power supply pins 47 are moved away from the collector members 27 with the result that the insulating sleeves 49 are moved away from the associated tapered positioning rings 37, and cover the entire power supply pins 47.

In this state, the printing drum 1 can rotate freely, and the entire power supply pins 47 are covered by the insulating sleeves 49 for preventing short-circuiting and electric shock.

Figure 6:
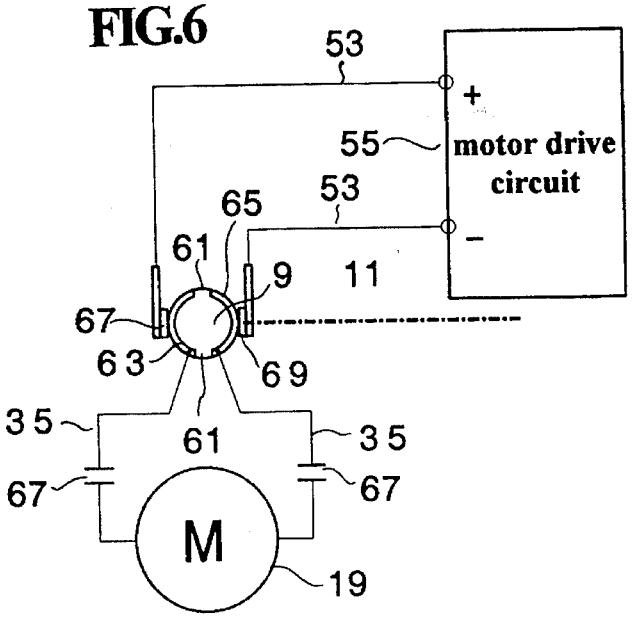
FIG. 6 is an electric circuit diagram of the master plate sheet clamping device for a printer according to the present invention.
Figure 5:
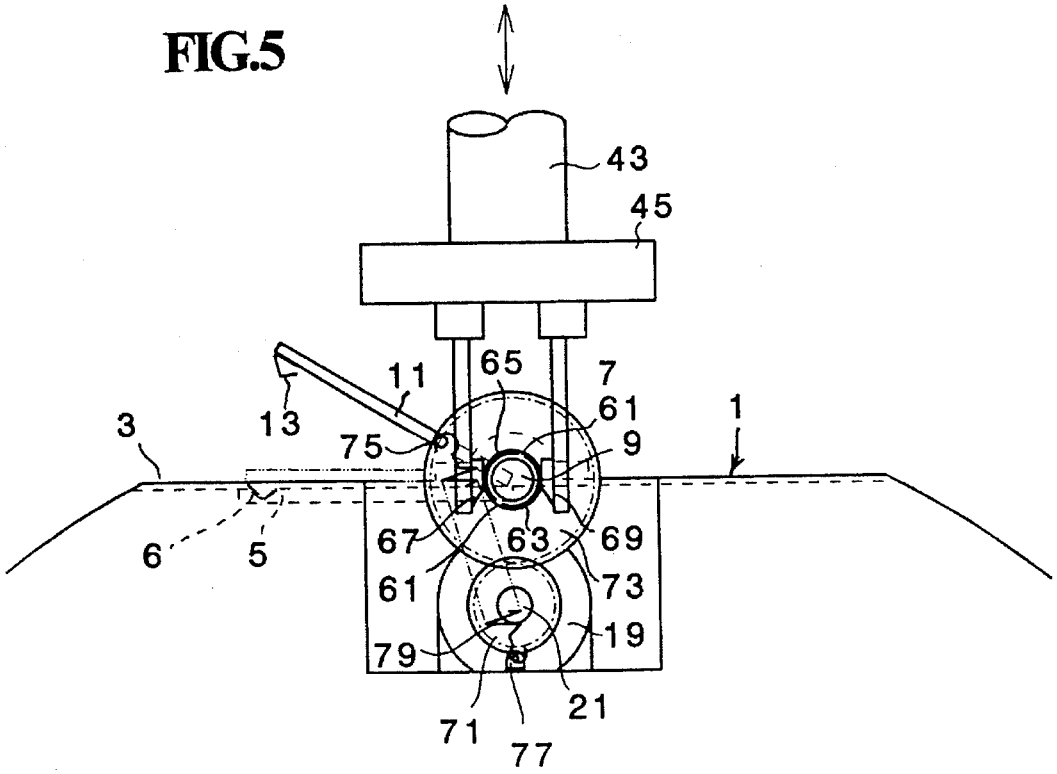
FIG. 5 is a side view showing another preferred embodiment of the master plate sheet clamping device for a printer according to the present invention.

FIGS. 5 and 6 show another embodiment of the master plate sheet clamping device for a printer according to the present invention. In FIGS. 5 and 6, the parts corresponding to those illustrated in FIGS. 1 through 4 are denoted with like numerals.

In this embodiment, a pair of collector contact plates 63 and 65 are attached to the outer circumferential surface of the support shaft 9 at an angular phase difference of 180 degrees with gaps 61 defined therebetween, and are electrically connected to the motor 19 via lead wires 35. A capacitor 67 is serially connected to each of the lead wires 35.

The power supply box 45 is provided with a pair of power supply brushes 67 and 69. With the vertical movement of the power supply box 45 caused by the vertical actuator 41, the power supply brushes 67 and 69 are brought into contact with the outer circumferential surface of the support shaft 9 from opposite directions. One of the power supply brushes 67 is connected to the positive terminal of the motor drive circuit 55, and the other power supply brush 69 is connected to the negative terminal of the motor drive circuit 55, by lead wires 53, respectively.

A spur gear 71 is fixedly fitted on an output shaft 21 of the motor 19 mounted on the printing drum 1, and always meshes with another spur gear 73 fixedly fitted on the support shaft 9.

A tension coil spring 79 is engaged between a pin 75 provided on the spur gear 73 and a spring engagement piece 77 mounted on the printing drum 1, and urges the moveable clamping plate 11 as a reversible spring either to the clamping position or to the unclamping position depending on which side of a neutral position the clamping plate 11 is located.

In this embodiment, electric power is supplied to the motor 19 via the power supply brushes 67 and 69, and the power collector plates 63 and 65.

As the support shaft 9 is rotatively driven by the motor 19, the power collector plates 63 and 65 undergo a 180 degree rotation between the clamping position and the unclamping position. In the clamping position, the power supply brush 67 contacts the power collector plate 65 while the power supply brush 69 contacts the power collector plate 63. In the unclamping position, the power supply brush 67 contacts the power collector plate 63 while the power supply brush 69 contacts the collector plate 65. Therefore, the polarity of the electric power supplied to the motor 19 reverses between the clamping and unclamping positions.

Thus, the motor drive circuit 55 is not required to carry out the control for reversing the rotational direction of the motor 19. Furthermore, because the polarity of the electric power supplied to the motor 19 is solely determined by the angular position of the support shaft 9, no error can occur in the rotational direction of the motor 19.

The supply of electric power to the motor 19 is stopped when the support shaft 9 is in such an angular position that the power supply brushes 67 and 69 are placed on the gaps 61, and the rotation of the motor 19 is continued thereafter for a short time interval by virtue of the electric charge stored in the capacitors 67. In the meantime, the moveable clamping plate 11 is moved either to the clamping position or the unclamping position assisted by the inertia force and the spring force of the tension coil spring 79.

In the master plate sheet clamping device for a printer according to the present invention, the supply of electric power may be made by an electric power generator mounted on the printing drum 1 and actuated by the rotation of the printing drum 1 or a battery carried by the printing drum 1. The control of the supply of electric power to the motor 19 may also be carried out by using an optical signal or the like from outside the printing drum 1 without requiring any contact.

As described above, according to the master plate sheet clamping device for a printer of the present invention, the power supply members on the side of the fixed member is electrically connected to the power collector members on the side of the printing drum, and electric power is thereby supplied to the motor (electric actuator). Because the moveable clamping member is moved between the clamping position and the unclamping position by the motor mounted on the printing drum, no large solenoid device is required for moving the motor between the meshing position and the release position, and the problem of having a difficulty in properly meshing the gear on the motor output shaft with the gear on the support shaft can be avoided. Furthermore, because the printing drum is not subjected to any rotational force when moving the moveable clamping member, there is no need to provide a mechanism for preventing the rotation of the printing drum due to the reaction force. All these factors contribute to the reliable clamping and unclamping action of the present invention with a highly simple structure.

Although the present invention has been described in terms of specific embodiments, it is possible to modify and alter details thereof without departing from the spirit of the present invention.

What we claim is:

1. A master plate sheet clamping device for a rotary printer which clamps a master plate sheet on an outer circumferential surface of a rotatively driven printing drum, comprising:

a support shaft rotatably mounted on said printing drum;

a moveable clamping member secured to said support shaft so as to be moveable between a clamping position for clamping a master plate sheet onto an outer circumferential surface of said printing drum and an unclamping position for releasing said master plate sheet from said printing drum;

a rotary motor mounted on said printing drum for actuating said moveable clamping member between said clamping position and said unclamping position;

transmitting means mounted on said printing drum for transmitting rotation of said motor to said support shaft; and electric power supply means for supplying electric power to said motor.

2. A master plate sheet clamping device according to claim 1, further comprising a power collector member electrically connected to said motor and mounted on said printing drum, and wherein said electric power supply means comprises a power supply member connected to an external power source and mounted on a fixed member of said printer for selective movement into contact with and away from said power collector member.

3. A master plate sheet clamping device according to claim 2, wherein said power supply member comprises a pin, and said power collector member comprises socket means adapted to receive said pin for establishing an electric contact therebetween.

4. A master plate sheet clamping device according to claim 3, wherein said power supply member further comprises an insulating sleeve which is slidably fitted on said pin, and adapted to be retracted so as to expose said pin when said pin is fitted into said socket means.

5. A master plate sheet clamping device according to claim 1, further comprising control means for controlling said motor, said control means comprising electric current detecting means for detecting a value of electric current supplied to said motor, and electric current control means for stopping the operation of said motor when an electric current detected by said electric current detecting means has exceeded a prescribe value as being indicative of said moveable clamping member reaching said clamping position or said unclamping position.

6. A master plate sheet clamping device according to claim 1, wherein said motor comprises means for preventing said motor from being moved by a movement of said moveable clamping member.

7. A master plate sheet clamping device according to claim 3, wherein said moveable clamping member comprises a spring element for elastically clamping said master plate sheet against an outer circumferential surface of said printing drum.

8. A master plate sheet clamping device according to claim 1, wherein said power supply member comprises a pair of power supply brush members, and said power collector member comprises a commutator including a pair of electroconductive segments and insulating gaps defined between said segments adapted to be contacted by said power supply brush members, said segments and said gaps determining a direction and an ending of movement of said motor.

9. A master plate sheet clamping device according to claim 1, further comprising spring means for urging said moveable clamping member toward said clamping position and said unclamping position depending on which side of a neutral position said moveable clamping member is located.

* * * * *